United States Patent [19]

Stier et al.

[11] Patent Number: 4,931,330

[45] Date of Patent: Jun. 5, 1990

[54] PREFABRICATED, SLIP-RESISTANT SURFACE COATING

[76] Inventors: Sam S. Stier, 620 NW. 76th Ter., Plantation, Fla. 33324; Robert E. Kaufman, 11615 NE. 20th Dr., North Miami, Fla. 33181

[21] Appl. No.: 178,764

[22] Filed: Mar. 29, 1988

Related U.S. Application Data

[63] Continuation of Ser. No. 751,542, Jul. 3, 1985, abandoned.

[51] Int. Cl.[5] ..... B32B 5/16; B32B 7/10; B32B 19/02; B32B 27/36

[52] U.S. Cl. ..... 428/40; 4/582; 4/583; 428/149; 428/331; 428/343; 428/351; 428/354

[58] Field of Search ..... 428/40, 149, 150, 343, 428/354

[56] References Cited

U.S. PATENT DOCUMENTS

| | | | |
|---|---|---|---|
| 2,921,869 | 1/1960 | McBride | 428/331 |
| 3,578,550 | 5/1971 | Hoerner et al. | 428/331 X |
| 3,836,420 | 9/1974 | Freese | 4/582 X |
| 4,328,274 | 5/1982 | Tarbutton | 428/149 |
| 4,336,293 | 6/1982 | Eiden | 428/331 X |
| 4,353,959 | 12/1982 | Olson et al. | 428/331 |
| 4,363,145 | 12/1982 | Kawesch | 4/583 |
| 4,379,802 | 4/1983 | Weaver et al. | 428/220 |
| 4,399,179 | 8/1983 | Minami et al. | 428/331 X |
| 4,505,974 | 3/1985 | Hosler | 428/331 X |
| 4,518,641 | 5/1985 | Shimmin et al. | 428/331 X |
| 4,625,344 | 12/1986 | Howard | 4/581 |

FOREIGN PATENT DOCUMENTS

| | | |
|---|---|---|
| 103775 | 5/1938 | Australia . |
| 2505208 | 8/1975 | Fed. Rep. of Germany . |
| 971741 | 10/1964 | United Kingdom . |
| 1481876 | 8/1977 | United Kingdom . |

OTHER PUBLICATIONS

3M, *Antislip Material* (1982).

*Primary Examiner*—George F. Lesmes
*Assistant Examiner*—J. Davis
*Attorney, Agent, or Firm*—Fitzpatrick, Cella, Harper & Scinto

[57] ABSTRACT

The invention relates to a prefabricated, slip-resistant surface coating which comprises a sheet member having a film on its surface, said film embedded therein in plurality of finely divided abrasive particles. This coating can be adapted to make a bathtub surface slip-resistant.

15 Claims, 1 Drawing Sheet

FIG. 1
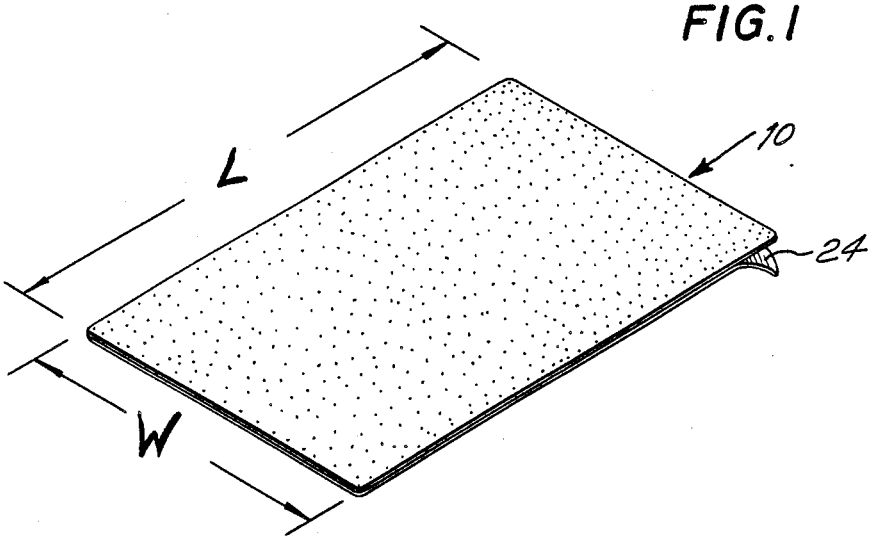
FIG. 2
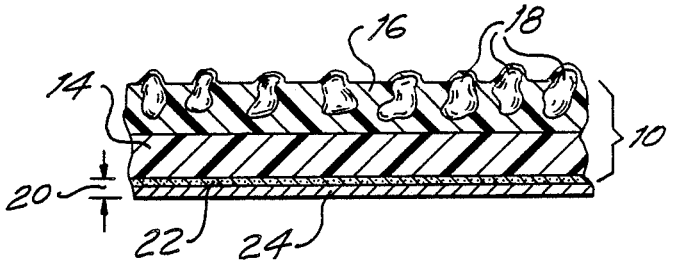
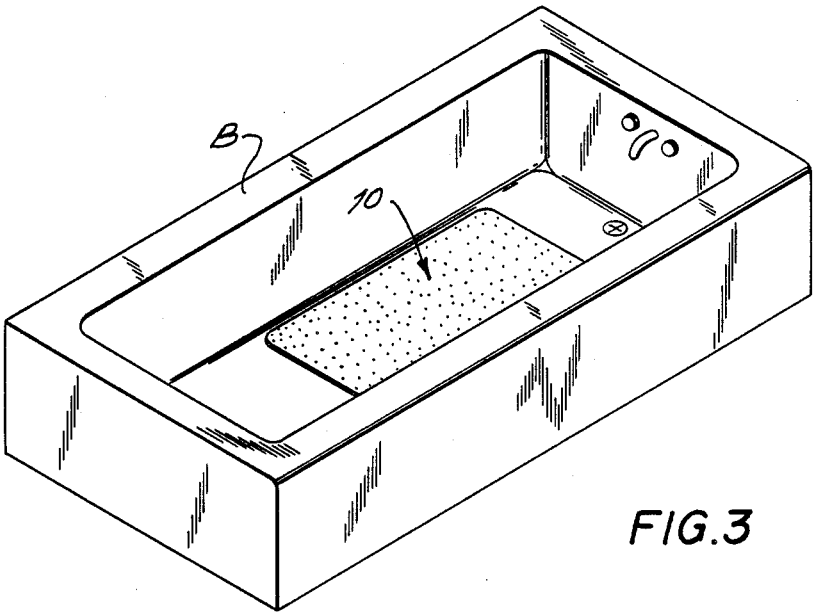
FIG. 3

PREFABRICATED, SLIP-RESISTANT SURFACE COATING

This application is a continuation of application Ser. No. 751,542 filed July 3, 1985 now abandoned.

BACKGROUND OF THE INVENTION

1. Field of the Invention

This invention relates to a prefabricated, slip-resistant surface coating, and more particularly, to a prefabricated coating adapted to make a bathtub surface slip-resistant.

2. Description of the Prior Art

Many techniques have been used to reduce the hazard presented by wet bathtubs. One well known prior art technique employs vinyl patches having on one side a textured surface and having on the other side an adhesive designed to hold the patches on the bottom of the bathtub. Unfortunately, these vinyl patches have shortcomings that seriously limit their utility. First, they must be made sufficiently thick to be able to provide a textured surface; that is, since it is the transitions between thick and thin areas which provide the patches' non-slip property, they must be made thick enough to provide both thick and thin portions. As a result, it is always apparent that the patches are added to rather than being an integral part of the bathtub. This shortcoming has been addressed by frankly acknowledging that such patches are simply stuck on the tub and trying to make them as attractive as possible so that they can be used as decoration. The decorative ability of the patches has been further enhanced by providing them in colors to compliment the tub color and in attractive shapes. However, many still consider such patches so unattractive that they would rather risk injury than use them.

In any case, this approach remains an imperfect solution because the patches, which must be made sufficiently thick to provide a textured surface and of a flexible material such as vinyl to provide the textured surface with a comfortable "feel" and sufficient slip-resistance, are easily worked loose from the tub surface. For example, repeatedly rubbing the tub to clean it tends to peel the edges of the patches away from the tub because of their excessive thickness. Once an edge of a patch begins to work loose from the tub, dirt sticks to the residual adhesive on the exposed surface of the patch and on the tub, presenting an extremely unattractive appearance. Moreover, once an edge works loose, the area of the loose portion progressively and irreversibly increases, and the patch becomes even more unattractive.

The problem of maintaining an intimate bond between the entire surface of the patch and the tub is aggravated because the patches are made of vinyl, the flexibility and thermal instability of which causes the patch to move against the tub when the tub is being used of cleaned, thereby increasing even further the likelihood of the patch working loose from the tub surface. Moreover, the material properties of vinyl also limit the number of adhesives that can be used, thereby further reducing the strength of the bond between the patches and the tub.

Finally, the adhesives that are used for such patches, while perhaps failing to bond intimately to the patch, do nevertheless tend to have a very good affinity for the smooth surfaces used for bathtubs, such as epoxy or porcelain, and, when the patch is finally removed, great difficulty is encountered in removing residual adhesive from the tub.

Thus, although such patches reduce the hazard presented by a wet bathtub, they have proved to be a less than ideal solution.

Another technique of providing a slip-resistant surface on a bathtub, more recent in origin, involves providing a coating on the tub surface using a preparation such as a liquid resin having silica particles suspended in it. After adding any necessary additional ingredients, such as a suitable catalyst or thinning agent, a thin coating of the preparation is spread on the tub surface, which, when cured, provides an essentially waterproof coating that is intimately bonded to the tub. Since this coating is no thicker than a layer of paint, it can be made virtually invisible if a clear polymer is used and it thus appears to be part of the tub. And if the bottom of the bathtub is worn, the coating can be tinted, so that application thereof effectively provides a new finish on the bottom of the tub.

This technique, although extremely effective for its intended purpose, is primarily useful only in commercial settings, such as hotels, because it requires professional expertise to prepare and apply the polymer-silica preparation, which is feasible financially only when a tub needs refinishing or a large number of tubs are to be threaded. It is generally too expensive for homeowners to employ such a coating simply as a safety measure on tubs that are still in acceptable condition. Moreover, after the coating is applied, the bathtub cannot be used while the coating cures. This not only tends to be unacceptable to homeowners, because of the obvious inconvenience resulting from the loss of the use of their bathtubs, but also is undesirable even for commercial users such as hotels because of the resulting loss of revenue.

SUMMARY OF THE INVENTION

It is an object of the present invention to overcome these shortcomings of the prior art.

In accordance with an aspect of the present invention, a prefabricated, slip-resistant surface coating comprises a sheet member and a film on the sheet member, which film has embedded therein a plurality of finely-divided abrasive particles.

The above and other objects of the present invention will become apparent when considering the detailed description of the preferred embodiments of the invention which follow.

BRIEF DESCRIPTION OF THE DRAWINGS

FIG. 1 is a perspective view of a prefabricated, slip-resistant surface coating in accordance with an aspect of the present invention.

FIG. 2 is a cross-sectional view of the coating shown in FIG. 1.

FIG. 3 is a perspective view of a bathtub having the prefabricated, slip-resistant surface coating shown in FIG. 1 installed therein.

DETAILED DESCRIPTION OF THE PREFERRED EMBODIMENTS

FIGS. 1 and 2 depict a preferred embodiment of the present invention. A prefabricated, slip-resistant surface coating 10 provided in accordance with the present invention comprises a sheet member 14 having on one surface thereof a film 16, which film has embedded therein a plurality of finely-divided abrasive particles 18. An adhesive layer 20 covers the other surface of the sheet member 14, that is, the surface opposite the surface on which the film 16 is provided. The adhesive layer 20 includes an adhesive substance 22 covered by a non-adhesive covering 24.

In a preferred embodiment, the sheet member is made of a clear, polyethylene terephthalate which is about 0.005 inches thick. While other materials can be used for the sheet member 14, it has been found that polyethylene terephthalate is extremely stable thermally and is rigid enough to resist deformation when subjected to shear forces on its opposite surfaces, such as those to which it would be subjected in use in a bathtub, and when in use in a bathtub. Moreover, since the sheet member 14 is very thin, such shear forces are even less likely to deform it.

The film 16 is preferably (a) a nylon-modified polyester urethane provided, with a catalyst having the name "Polythane-Part A", by Preservo Paint Co., 9013 East Alameda at Brolier, Houston, Tex. 77025, (b) an acrylic polyurethane provided, with a polyisocyanate catalyst, by Horizons Company, 14805 49th Street, Clearwater, Fla. 33520, or (c) an acrylic sealer (methyl butyl methacrylate copolymer) available from E Bond Epoxy Co., 501 N.E. 33rd Street, Ft. Lauderdale, Fla. 33334. The abrasive particles 18 are typically silica in one of two grades, such as can be obtained from U.S. Paint, 831 South 21st Street, St. Louis, Mo. 63103, as "Griptex 73012 fine non/skid particles (non-photochemically reactive)", a grade which provides a very finely textured film 16, or "Griptex 73013 coarse non/skid particles (non-photochemically reactive)", which provide a coarser film 16. Such fine particles average about 150 microns and the coarse particles average about 200 microns.

To provide a prefabricated, slip-resistant surface coating comprising the sheet member 14 and the film 16, these ingredients are combined in the proportions of two fluid ounces of clear polyurethane or polyester urethane for each gram of the silica particles, either fine or coarse, and are blended thoroughly and then allowed to rest for between 12 and 36 hours. This mixture is then blended with the catalyst provided with the polyurethane or polyester urethane by the manufacturer and with a suitable thinning agent, such as methyl ethyl ketone or toluene, provided in amounts sufficient to provide a preparation with a suitable consistency, but generally no more than the amount of polyurethane or polyester urethane that was used. This preparation is then coated on one surface of the polyethylene terephthalate sheet member, which has the adhesive substance 22 and non-adhesive covering 24 on the other surface thereof, in a suitable manner, such as by spraying, brushing or smoothing it out with a blade drawn across the surface, and is then allowed to cure for 12 to 36 hours until hard and dry.

In another aspect of the invention, the prefabricated, slip-resistant surface coating can be made opaque and colored. This is accomplished in a preferred manner by using two fluid ounces of the system comprising the desired polyurethane or polyester urethane polymer, a suitable catalyst and appropriate thinner, for every four grams of the Griptex non/skid particles. If desired, both coarse and fine particles can be combined to make up the number of particles required. The polymer and the finely divided particles are blended, with sufficient pigment to provide the desired color, and, after blending, this system is allowed to rest for 12 to 36 hours, as before, and is then combined with an amount of catalyst equal to the amount of polymer that was used and an appropriate amount of thinner, preferably up to about one-half of the amount of polymer that was used, and is then applied as before to the polyethylene terephthalate sheet member, which has the adhesive substance and non-adhesive layer thereon, and allowed to cure for 12 to 36 hours until hard and dry.

If acrylic sealer is used, it is mixed in the proportions of two fluid ounces of acrylic sealer with each gram of fine silica particles, blended and allowed to rest for 12 to 36 hours. Although no catalyst is required, a suitable thinner, such as methyl ethyl ketone, may be added if required to facilitate application. This preparation is applied as before to a polyethylene terephthalate sheet member, with an adhesive substance and non-adhesive layer thereon, and allowed to cure for 2 to 3 hours until hard and dry.

It will be apparent that suitable pigments can be added to any of these preparations and other types of abrasive particles can be used, just to mention two modifications, without departing from the spirit of the invention.

A suitable adhesive substance 12 is one having a permanent migration acrylic base with suitable additives to provide desired properties. A suitable non-adhesive covering 24 comprises a waxed paper provided on top of the adhesive substance to enable more convenient transportation and storage of the prefabricated, slip-resistant surface coating.

FIG. 3 shows a bathtub having applied thereto a prefabricated, slip-resistant surface coating in accordance with the present invention. To apply the surface coating the covering 24 is peeled from the adhesive substance and the sheet member is then placed in the bathtub at the desired location and pressed in place to remove all air bubbles and obtain an intimate bond with the surface of the bathtub. Of course "bathtub", as used herein, includes shower stalls or similar installations.

While the dimensions L and W of the surface coating of the present invention are typically chosen so that only the area of the bathtub used while showering is covered by the inventive slip-resistant coating, clearly the dimensions might be increased, decreased or otherwise changed to cover any desired portion of a bathtub, according to the wishes of the user. A size that covers the entire bathtub bottom would find particular utility in cases where defects have been caused by abuse or wear and which require covering by an opaque, colored prefabricated slip-resistant surface coating in accordance with the present invention.

Because the overall thickness of the prefabricated, slip-resistant surface coating provided by the present invention is extremely thin, it gives the appearance of completely "blending into" the tub so that it is nearly impossible even to detect that a separate member has been placed in the bathtub. This both enhances the appearance of the bathtub while also preventing the surface coating from coming loose from the tub bottom. The adhesion of the surface coating to the article to which it is applied is further enhanced by making the sheet member 14 of a thermally stable material. Moreover, by using a sheet member without plasticizers (which are contained in vinyl, for example), in accordance with a preferred embodiment of the invention, the number of suitable adhesives is greatly enlarged, thus enabling the provision of a better, more permanent bond between the sheet member and the tub.

Although several specific embodiments of the invention have been described in detail herein with reference to the accompanying drawings, it is to be understood that the invention is not limited to those embodiments and that various changes and modifications other than those particularly pointed out above, such as providing a sheet member with a film incorporating finely-divided abrasive particles over only a portion of the surface thereof, or in decorative patterns in colors that would contrast with the tub, can be made by one skilled in the art without departing from the scope of sprit of the invention as defined in the following claims.

What is claimed is:

1. A prefabricated, self-adhesive and slip-resistant surface coating, comprising:

a non-deformable polyethylene terephthalate sheet member providing two opposing surfaces, said sheet member being of a thickness of about 0.005 inches and is rigid and resists shear on said two opposing surface;

a film on one surface of said sheet member, said film comprising an acrylic polyurethane and having completely imbedded therein a plurality of finely-divided abrasive silica particles, said particles having an average diameter of from about 150 to 200 microns, said particles being completely covered by said acrylic polyurethane film; and an adhesive layer on the other surface of said sheet member for enabling said surface coating to be attached to any desired location on a smooth receiving surface.

2. A prefabricated, slip-resistant surface coating as recited in claim 1, wherein said sheet member is clear.

3. A prefabricated, slip-resistant surface coating as recited in claim 2, wherein said film is clear.

4. A prefabricated, slip-resistant surface coating as recited in claim 2, wherein said film is opaque and colored.

5. A prefabricated, slip-resistant surface coating as recited in claim 1, wherein the size of said finely-divided particles is about 150 microns average or 200 microns average.

6. A prefabricated, slip-resistant surface coating as recited in claim 1, adapted to be adhered to the bottom of a bathtub, wherein said adhesive layer on the other surface of said sheet member is essentially waterproof.

7. A prefabricated, slip-resistant surface coating as recited in claim 6, wherein said sheet member is a thermally stable material substantially without plasticizers.

8. A prefabricated, slip-resistant surface coating as recited in claim 1, wherein said liquid resin consists essentially of an acrylic polyurethane.

9. A prefabricated, slip-resistant surface coating as recited in claim 1, wherein said adhesive layer includes a removable non-adhesive covering on the surface of said adhesive substance.

10. A prefabricated, slip-resistant surface coating as recited in claim 9, wherein said film and said adhesive substance cover substantially all of said respective surfaces of said sheet member.

11. A prefabricated, slip-resistant surface coating as recited in claim 10, wherein said film and said adhesive substance are substantially clear.

12. A prefabricated, slip-resistant surface coating as recited in claim 10, wherein said adhesive substance is substantially clear and said film is opaque and colored.

13. A prefabricated, slip-resistant surface coating as recited in claim 9, wherein said sheet member has dimensions permitting it to fit the bottom of a bathtub.

14. A prefabricated, slip-resistant surface coating as recited in claim 1, wherein said sheet member does not contain a plasticizer.

15. A prefabricated, slip-resistant surface coating as recited in claim 14, wherein said sheet member is thermally stable.

* * * * *